US006835705B2

(12) United States Patent
Shaukat et al.

(10) Patent No.: US 6,835,705 B2
(45) Date of Patent: Dec. 28, 2004

(54) VISCOSITY-STABILIZING CLEANING COMPOSITION

(75) Inventors: Anjum Shaukat, Middlesex (GB); Colin William Brown, Engham (GB); Gerald Leslie Hart, deceased, late of Surbiton (GB); by Susan Hart, legal representative, Surbiton (GB)

(73) Assignee: Givaudan SA, Dubendorf (CH)

( * ) Notice: Subject to any disclaimer, the term of this patent is extended or adjusted under 35 U.S.C. 154(b) by 0 days.

(21) Appl. No.: 10/163,758

(22) Filed: Jun. 6, 2002

(65) Prior Publication Data

US 2003/0008792 A1 Jan. 9, 2003

Related U.S. Application Data

(63) Continuation-in-part of application No. 09/877,894, filed on Jun. 8, 2002, now abandoned.

(51) Int. Cl.[7] ..... C11D 17/00

(52) U.S. Cl. ..... 510/417; 510/425; 510/426; 510/505; 510/506

(58) Field of Search ..... 510/425, 426, 510/417, 505, 506, 476

(56) References Cited

U.S. PATENT DOCUMENTS

| | | | | |
|---|---|---|---|---|
| 5,891,836 A | | 4/1999 | Kacher | |
| 6,178,564 B1 | | 1/2001 | Leonard et al. | |
| 6,274,546 B1 | * | 8/2001 | Legel et al. | 510/465 |
| 6,291,418 B1 | * | 9/2001 | Mertens et al. | 510/417 |

FOREIGN PATENT DOCUMENTS

| | | |
|---|---|---|
| EP | 0 538 957 | 3/1996 |
| EP | 1 046 755 | 10/2000 |

* cited by examiner

*Primary Examiner*—Necholus Ogden
(74) *Attorney, Agent, or Firm*—Norris McLaughlin & Marcus PA

(57) ABSTRACT

A cleaning composition containing a viscosity-stabilizing amount of tripropylene glycol monomethyl ether, dipropylene glycol monomethyl ether, and sodium di-alkyl sulphosuccinate is provided. Furthermore, cleaning compositions comprising hydroxyethyl cellulose, diethylene glycol monoethyl ether, tripropylene glycol monomethyl ether, dipropylene glycol monomethyl ether, sodium alkyl ethoxy sulphate, sodium lauryl sulphate, cocoamide diethanolamine, a sodium di-alkyl sulphosuccinate, and water which demonstrates superior viscosity stability are disclosed. The invention also provides methods of forming same.

18 Claims, No Drawings

VISCOSITY-STABILIZING CLEANING COMPOSITION

This application is a continuation in part of U.S. Ser. No. 09/877,894, filed Jun. 8, 2001, now abandoned.

The present invention relates to a viscosity-stabilising composition. More particularly the invention relates to a viscosity-stabilising composition containing a mixture of glycol monoalkyl ethers, in particular monomethyl ethers and/or monoethyl ethers, e.g. tripropylene glycol monomethyl ether, dipropylene glycol monomethyl ether, and further including sodium di-alkyl sulphosuccinate. The invention further relates to cleaning compositions containing a viscosity-stabilising composition. Methods of forming said compositions are also provided, as are methods of stabilising the viscosity of cleaning compositions containing a fragrance.

Liquid formulations are well known for toilet rim-mounted cleaner and freshener devices. Such devices are taught in Leonard et al., U.S. Pat. No. 6,178,564 ("Leonard"); Camp, European Pat. No. 1,046,755 A1 ("Camp"); and Bosselaar et al., European Patent No. 538, 957 A1 ("Bosselaar"). The formulations of such devices normally contain thickening agents, such as carboxymethyl cellulose or natural gums. They also contain varying amounts of nonionic and anionic surfactants as well as preservatives, dyes, and fragrances. Some formulations may also contain EDTA and phosphonates for anti-limescale performance.

Bosselaar describes a cleansing and/or freshening-liquid unit for a toilet bowl. The cleaning liquid is held in a reservoir and is in constant contact with a sponge. When the unit is in use, the sponge is in the path of the flowing water. In that way the cleansing and/or freshening liquid is communicated to the water as it flows over the sponge. Accordingly, the viscosity of the liquid is of critical importance in maintaining the continuous and sufficient delivery of the liquid to the sponge and subsequently to the water.

Camp also provides a cleansing and freshening unit for a toilet bowl. A reservoir holds the liquid cleansing agent and the liquid is in continuous contact with a sponge. The sponge is positioned to be in the path of the flowing water when the toilet is flushed. In contrast to Bosselaar, Camp provides openings in the reservoir that can be adjusted to vary the rate of flow of the liquid. The adjustment of these openings is dictated by the viscosity of the liquid cleansing agent used.

Leonard provides a liquid dispensing toilet bowl cleaning unit. Leonard eschews the use of a sponge, and instead provides a delivery plate to deliver the cleaning liquid to the water. The delivery plate has channels for dispersing the cleaning liquid over the upper surface of the delivery plate. These channels are of various designs. The cleaning liquid is held in a reservoir and delivered to the delivery plate through a feed conduit. When the toilet is flushed the water flows over the upper surface of the delivery plate and the cleaning liquid is washed into the toilet bowl. Leonard provides vent openings to provide adequate flow of the cleaning liquid from the reservoir to the delivery plate. Once again, the viscosity of the liquid used dictates the rate of the flow of the liquid to the upper surface of the delivery plate.

The addition of a fragrance, or other ingredients, to the liquid cleaning agent of these systems greatly affects the viscosity of the liquid formulation and also the stability of viscosity over time and temperature. These variations in viscosity will greatly affect the delivery of the liquid cleaning products in these structures. Accordingly, a liquid with stable viscosity over time and temperature will allow for more efficient production of these cleansing units and delivery of the cleaning liquid by the units.

Due to these variations in viscosity, a liquid cleaning product may need to be formulated differently for each color and/or fragrance combination desired, depending on the precise characteristics of the fragrance(s) and/or color(s) used. Obviously, this makes the manufacture of a product line with various fragrance and color combinations inefficient. It is therefore desirable to have a single base formulation to which a variety of fragrances, and other components, can be added without significantly impacting the viscosity characteristics of the final composition. In addition, it is desirable to have a viscosity-stabilising composition containing viscosity stabilizing ingredients, and optionally at least one fragrance, to which other components can be admixed to form a cleaning composition without significantly affecting the viscosity of the cleaning composition.

Applicant has surprisingly found that by admixing a viscosity-stabilising composition containing mixtures of glycol monomethyl ethers and/or monoethyl ethers to liquid cleaning compositions, one is able to provide the cleaning compositions with constant and stable viscosity characteristics over prolonged periods of time, even when the compositions contain fragrance.

Accordingly, the invention provides in a first aspect a viscosity-stabilising composition comprising mixtures of glycol monomethyl ethers and/or monoethyl ethers.

The invention provides in another of its aspects a cleaning composition comprising a viscosity-stabilising composition as hereinabove defined, and further including a modified cellulose, an ethoxylated anionic surfactant, a sulphosuccinate surfactant, a further anionic surfactant not being an ethoxylated anionic surfactant or a sulphosuccinate, and water.

In another aspect of the invention there is provided a method of stabilising the viscosity of a cleaning composition as aforementioned, by admixing the aforementioned viscosity-stabilising composition into the aforementioned further ingredients of the cleaning composition referred to in the preceding paragraph.

The mixtures of the glycol monomethyl ethers and/or monoethyl ethers suitable for use in the present invention may be formed by combining known art glycol monomethyl ethers and/or monoethyl ethers. Examples of such include dipropylene glycol monomethyl ether, tripropylene glycol monomethyl ether, propylene glycol monomethyl ether, diethylene glycol monomethyl ether, and triethylene glycol monomethyl ether. Useful glycol ethers include those available from commercial sources, including those marketed as ARCOSOLV™, DOWANOL™ and CARBITOL glycol ethers. The mixture of glycol ethers may be present in a cleaning composition in amounts up to about 20% by weight, e.g. 1 to 20% by weight.

The modified celluloses suitable for use in the present invention include those generally known to those of skill in the art. Examples of such modified celluloses include hydroxyethyl cellulose, hydroxypropyl cellulose, methyl cellulose, hydroxypropyl methyl cellulose, ethyl hydroxyethyl cellulose, methyl hydroxyethyl cellulose, and combinations thereof. These materials are preferably employed in the cleaning composition in amounts of about 1.0 to 10.0% by weight.

The ethoxylated anionic surfactants suitable for use in the present invention include those generally known to those of skill in the art. Examples of such ethoxylated anionic surfactants include sodium alkyl ethoxy sulphate, and combinations thereof. These materials are preferably provided in amounts of about 3 to 20% by weight.

The sulphosuccinate surfactant may be selected from any of those known in the art. Preferred are the sodium salts of dialkylsulphosuccinates having short alkyl chains, e.g. $C_5$ to $C_8$ alkyl, and more particularly the dibutyl, dihexyl and diethylhexyl sulphosuccinates, although other dialkylsulphosuccinates can be employed as the skilled person would readily appreciate. These materials are preferably provided in amounts of about 1 to 10% by weight The further anionic surfactants suitable for use in the present invention are those generally known to those of skill in the art. Non-limiting examples of such anionic surfactants include sodium lauryl sulphate, alkyl sulfates, ethoxylated alkyl sulfates, alkyl glyceryl ether sulfonates, methyl acyl taurates, fatty acyl glycinates, alkyl ethoxy carboxylates, N-acyl glutamates, acyl isethionates, alkyl sulfosuccinates, alkyl ethoxy sulphosuccinates, alpha-sulfonated fatty acids, their salts and/or their esters, alkyl phosphate esters, ethoxylated alkyl phosphate esters, acyl sarcosinates and fatty acid/protein condensates, and mixtures thereof. These materials are preferably provided in amounts of about 0.1 to 1.0% by weight.

The surfactants described above may be provided in salt form. Having specific regard to the anionic surfactants described herein, not only sodium ion, but any salt forming counterion may be employed, for example alkali-metal salts and ammonium salts.

Preferred compositions according to the present invention additionally comprise a non-ionic surfactant. Non-ionic surfactants include those alkanolamides generally known in the art, for example alkanolamides including monoethanolamides and diethanolamides, particularly fatty monoalkanolamides and fatty dialkanolamides. Commercially available monoethanol amides and diethanol amides include those marketed under the trade names Alakamide® and Cyclomide® by Rhône-Poulenc Co., (Cranbury, N.J.) and include nonionic surfactants based on coconut diethanolamide; coconut monoethanolamide; a 2:1 coconut monoethanolamide; a 2:1 modified coconut monoethanolamide; a 1:1 coconut monoethanolamide; a 1:1 fatty acid diethanolamide; a lauric/linoleic diethanolamide; a 1:1 linoleic diethanolamide; a 2:1 lauric diethanolamide; a 1:1 lauric diethanolamide; a 1:1 lauric/myristic diethanolamide; a 2:1 oleic diethanolamide; a 1:1 oleic diethanolamide; a 1:1 stearic diethanolamide; a 1:1 coconut diethanolamide; a 1:1 lauric diethanolamide; a lauric monoisopropanolamide a lauric monoethanolamide; a stearic monoethanolamide; diethanolamides of unsaturated fatty acids; Cyclomide® 101 CG described to be an alkanolamide nonionic surfactant; Cyclomide® 200 CGN based on coconut oil diethanolamide; as well as Cyclomide® 206 CGN and Cyclomide® 210 CGN, both described to be a nonionic surfactants based on coconut alkanolamide A preferred example of an alkanolamide is cocamide diethanolamine. When present, the non-ionic surfactants may be present in amounts of about 0.5 to 5.0% by weight.

In the present invention the cleaning composition may also contain at least one additional component. The additional component(s) can be fragrances, dyes, preservatives, anti-lime scale agents, and combinations thereof. Preferably the additional component is a fragrance.

Preferably, boron and boron-containing compounds are absent from the inventive compositions and inventive processes.

The fragrances suitable for use in the present invention are those generally known to those of skill in the art. Examples of such fragrances include digeranyl succinate, dineryl succinate, geranyl neryl succinate, geranyl phenylacetate, neryl phenylacetate, geranyl laurate, neryl laurate, di(b-citronellyl) maleate, dinonadol maleate, diphenoxyanol maleate, di(3,7-dimethyl-1-octanyl) succinate, di(cyclohexylethyl) maleate, diflralyl succinate, di(phenylethyl) adipate, 7-acetyl-1,2,3,4,5,6,7,8-octahydro-1,1,6,7-tetramethyl naphthalene, ionone methyl, ionone gamma methyl, methyl cedrylone, methyl dihydrojasmonate, methyl 1,6,10-trimethyl-2,5,9-cyclododecatrien-1-yl ketone, 7-acetyl-1,1,3,4,4,6-hexamethyl tetralin, 4-acetyl-6-tert-butyl-1,1-dimethyl indane, para -hydroxy-phenyl-butanone benzophenone, methyl beta-naphthyl ketone, 6-acetyl-1,1,2,3,3,5hexamethyl indane, 5-acetyl-3-isopropyl-1,1,2,6-tetramehtyl indane, 1-dodecanal, 4-(4-hydroxy-4-methylpentyl)-3-cyclohexene-1-carboxaldehyde, 7-hydroxy-3,7-dimethyl ocatanal, 10-undecen-1-al, isohexenyl cyclohexyl carboxaldehyde, formyl tricyclodecane, condensation products of hydroxycitronellal and methyl anthranilate, condensation products of hydroxycitronellal and indol, condensation products of phenyl acetaldehyde and indol, 2-methyl-3-(para-tert-butylphenyl)-propionaldehyde, ethyl vanillin, heliotropin, hexyl cinnamic aldehyde, amyl cinnamic aldehyde, 2-methyl-2-(para-isopropylphenyl)propionaldehyde, coumarin, decalactone gamma, cyclopentadecanolide, 16-hydroxy-9-hexadecenoic acid lactone, 1,3,4,6,7,8-hexahydro-4,6,6,7,8,8-hexamethylcyclopenta-gamma-2-benzopyrane, beta-naphthol methyl ether, ambroxane, dodecahydro-3a,6,6,9a-tetramethyinaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-buten-1-ol, caryophyllene alcohol, tricyclodecenyl propionate, tricyclodecenyl acetate, benzyl salicylate, cedryl acetate, para-(tert-butyl) cyclohexyl acetate, essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin, and lavender, phenyl ethyl alcohol, terpineol, linalool, linalyl acetate, geraniol, nerol, 2-(1,1-dimethylethyl)cyclohexanol acetate, benzyl acetate, orange terpenes, eugenol, diethylphthalate, and combinations thereof. These materials are preferably provided in amounts of about 0.2 to 5% by weight.

The dyes suitable for use in the present invention are those generally known to those of skill in the art. Examples of such dyes include copper phthalocyanine tetrasulfonic acid tetra sodium salt, all derivatized and underivatized phthalocyanines such as Pigment Green 7, Pigment Blue 15, and Pigment Blue 86, inorganic pigments, such as lazurite, and combinations thereof. However any water soluble or water dispersible dye or other coloring agent may be used.

The preservatives suitable for use in the present invention are those generally known to those of skill in the art. Examples of such preservatives include formalin, 5-bromo-5-nitro-dioxan-1,3, 5-chloro-2-methyl-4-isothaliazolin-3-one, 2,6-di-tert.butyl-p-cresol, parabens including methyl parabens and ethyl parabens, glutaraldehyde, formaldehyde, 5-chloro-2-methyl-4-isothiazolin3-one, 2-methyl-4-isothiazoline-3-one, a mixture of 5-chloro-2-methyl-4-isothiazolin-3-one and 2-methyl-4-isothiazolin-3-one marketed under the trademark KATHON® CG/ICP , and combinations thereof. These materials may be provided in effective amounts to achieve the desired preservative effect.

The anti-lime scale agents suitable for use in the present invention are those generally known to those of skill in the art. Examples of such anti-lime scale agents include ethylene diamine tetracetic acid (EDTA), diethylene triamine pentacetic acid (DTPA), nitrilotriacetic acid (NTA), hydroxylethyl ethylene diamine triacetic acid (HEEDTA), salts of the foregoing, and combinations thereof.

In a preferred embodiment of the present invention there is provided a cleaning composition comprising hydroxyethyl cellulose, diethylene glycol monoethyl ether, tripropylene glycol monomethyl ether, dipropylene glycol monomethyl ether, sodium alkyl ethoxy sulphate, sodium lauryl sulphate, cocoamide diethanolamine, a sodium di-alkyl sulphosuccinate, and water.

In a particularly preferred embodiments of the present invention, the cleaning compositions contain: hydroxyethyl cellulose, diethylene glycol monoethyl ether, tripropylene glycol monomethyl ether, dipropylene glycol monomethyl ether, sodium alkyl ethoxy sulphate, sodium lauryl sulphate, cocoamide diethanolamine, sodium di-alkyl sulphosuccinate, a preservative, fragrance and water.

According to the present invention, the glycol monomethyl ethers and/or monoethyl ethers should be provided in a cleaning composition in viscosity-stabilising amounts. In a preferred embodiment mixtures of 2 or 3 ethers may be used and each of the ethers is provided in a cleaning composition in amounts of about 0.5 to 5.0% by weight, more particularly about 1.5 to about 3.5% by weight, especially about 2.5% by weight. In a particularly preferred embodiment tripropylene glycol monomethyl ether (TGME) is provided in amounts of 0.5 to 5.0, preferably from 1.5 to 3.5% by weight, and dipropylene glycol monomethyl ether (DGME) is provided in amounts of 0.5 to 5.0, preferably from 1.5 to 3.5% by weight, especially about 2.5% by weight.

Still more preferably, a cleaning composition of the present invention contains in addition to the glycol ethers in the amounts provided above, a sodium di-alkyl sulphosuccinate (SDAS) in amounts of from about 1 to 10% by weight, preferably from about 3 to 7% by weight, especially about 5% by weight.

With mixtures of glycol monomethyl ethers and/or monoethyl ethers present in these amounts, it is possible to obtain cleaning compositions with stable viscosities over prolonged periods of time. Additionally, by inclusion of a sodium di-alkyl sulphosuccinate (SDAS) said compositions may be further stabilised.

Advantageously, the weight ratio of TGME:DGME may be 1:1. The weight ratio of TGME:DGME:SDAS is advantageously 1:1:2.

Cleaning compositions of the present invention may be prepared by the simple admixture of the ingredients enumerated above. However, a preferred method comprises the steps of:

a. mixing the modified cellulose, with water to form a dispersion or solution; and
b. adding the mixture of glycol monomethyl ethers and/or monoethyl ethers; ethoxylated anionic surfactant; sulphosuccinate, further anionic surfactant, and optionally one or more other ingredients selected from a fragrance, a dye, a preservative, and an anti-lime scale agent.

In a more preferred method, to a solution of hydroxyethylcellulose in water is added, with mixing; a diethylene glycol monoethyl ether, tripropylene glycol monomethyl ether, and dipropylene glycol monomethyl ether; sodium alkyl ethoxy sulphate; sodium lauryl sulphate, cocoamide diethanolamine, and a sodium di-alkyl sulphosuccinate, to form the cleaning composition.

The following examples are provided to further illustrate the compositions and methods of the present invention. These examples are illustrative only and are not intended to limit the scope of the invention in any way.

EXAMPLE 1

Three formulations (formulations 1, 2, and 3) are shown below in which the base formula is the same and the only difference is the fragrance used (A, B, or C). The formulations are clear in appearance and can be formulated to any desired viscosity by altering the percentage of hydroxyethyl cellulose used.

TABLE 1

| | Formulations | | |
|---|---|---|---|
| Ingredient | Formulation 1 | Formulation 2 | Formulation 3 |
| NATRASOL 250 HHR ® | 0.50 | 0.50 | 0.50 |
| KATHON CG ICP ® | 0.05 | 0.05 | 0.05 |
| Isopropanol | 1.00 | 1.00 | 1.00 |
| CARBITOL ® | 6.00 | 6.00 | 6.00 |
| ARCOSOLV TPM ® | 1.00 | 1.00 | 1.00 |
| ARCOSOLV DPM ® | 1.50 | 1.50 | 1.50 |
| EMPICOL ESB 70 ® | 11.47 | 11.47 | 11.47 |
| EMPICOL LXSV/93S/U ® | 8.60 | 8.60 | 8.60 |
| REWOMID DC 212S ® | 2.25 | 2.25 | 2.25 |
| REWOPOL SBDO 75 ® | 2.60 | 2.60 | 2.60 |
| Fragrance A | 4.50 | — | — |
| Fragrance B | — | 4.50 | — |
| Fragrance C | — | — | 4.50 |
| Citric Acid | 0.11 | 0.11 | 0.11 |
| Water | 60.42 | 60.42 | 60.42 |

The proportions of each ingredient of the formulations in the Table 2 are in percent weight of total.

In these formulations, NATRASOL 250 HHR® refers to the thickener hydroxyethyl cellulose. KATHON CG ICP® refers to a preservative containing 1.5% of a mixture of 5-chloro-2-methyl-4-isothiazolin-3-one and 2-methyl-4-isothiazolin-3-one. CARBITOL® refers to diethylene glycol monoethyl ether. ARCOSOLV TPM® (Petrochem UK Ltd., London, England) refers to tripropylene glycol monomethyl ether and ARCOSOLV DPM® (Petrochem UK Ltd., London, England) refers to dipropylene glycol monomethyl ether. The glycol ethers contribute both to the clarity of the liquid and also to the stability of the viscosity. TGME and DGME are particularly important in maintaining the stability of the liquid at lower temperatures, i.e. 5° C. The glycol ethers also assist with the cleaning properties of the formula. EMPICOL ESB 70® (Huntsman Surfactant Sciences UK Ltd., West Midlands, England) refers to sodium alkyl ethoxy sulphate (70%) and EMPICOL LXSV 938/U® (Huntsman Surfactant Sciences UK Ltd., West Midlands, England) refers to sodium lauryl sulphate. REWOMID DC 212S® (Goldschmidt AG, Essen, Germany) refers to cocoamide diethanolamine and REWOPOL SBDO 75® (Goldschmidt AG, Essen, Germany) refers to sodium di-alkyl sulphosuccinate (75%). These four materials contribute to the foaming and cleaning properties of the formula. The sulphosuccinate is also significant in the stability of the viscosity. Fragrances A, B, and C are proprietary fragrances of Givaudan Fragrances. This system does not contain dye, though this can optionally be added and would normally be used in a commercial formula.

The formula is made by first dissolving the hydroxyethyl cellulose in the water and then adding the other ingredients in the order listed in Table 1, with mixing.

Table 2 reports the average of three viscosity measurements on formulations 1, 2, and 3 after storage at room temperature (21° C.), 5° C., and 37° C. (Brookfield LVT viscometer spindle 2, 6 rpm.)

TABLE 2

Viscosity (in cps) at various storage times and temperatures.

| Time (weeks) | Storage Temperature (° C.) | Formulation 1 | Formulation 2 | Formulation 3 |
|---|---|---|---|---|
| 1 | 5 | 2750 | 2900 | 2700 |
| 5 | 5 | 2865 | 2775 | 2800 |
| 8 | 5 | 2800 | 2700 | 2700 |
| 1 | 21 | 2825 | 2950 | 2860 |
| 5 | 21 | 2625 | 2685 | 2335 |
| 8 | 21 | 2640 | 2700 | 2350 |
| 1 | 37 | 2650 | 2850 | 2585 |
| 5 | 37 | 2115 | 2200 | 2225 |
| 8 | 37 | 2200 | 2250 | 2375 |

The results show that the viscosity values are similar for all three formulations. Additionally, the choice of fragrance has little effect on the viscosity of the final formulation. Additionally, the tendency of the viscosity to decrease over time at 37° C. does not continue beyond five (5) weeks. The viscosity values plateau at their five (5) week values.

EXAMPLE 2

Formulations 4, 5, and 6 are similar to formulations 1, 2, and 3 respectively, except formulations 4, 5, and 6 omit the use of TGME and DGME. Percentage by weight for each ingredient is reported in Table 3 for each formulation.

TABLE 3

| Ingredient | Formulations Formulation 4 | Formulation 5 | Formulation 6 |
|---|---|---|---|
| NATRASOL 250 HHR ® | 0.50 | 0.50 | 0.50 |
| KATHON CGICP ® | 0.05 | 0.05 | 0.05 |
| Isopropanol | 1.00 | 1.00 | 1.00 |
| CARBITOL ® | 6.00 | 6.00 | 6.00 |
| EMPICOL ESB 70 ® | 11.47 | 11.47 | 11.47 |
| EMPICOL LXSV/93S/U ® | 8.60 | 8.60 | 8.60 |
| REWOMID DC 212S ® | 2.25 | 2.25 | 2.25 |
| REWOPOL SBDO 75 ® | 2.60 | 2.60 | 2.60 |
| Fragrance A | 4.50 | — | — |
| Fragrance B | — | 4.50 | — |
| Fragrance C | — | — | 4.50 |
| Citric Acid | 0.11 | 0.11 | 0.11 |
| Water | 62.92 | 62.92 | 62.92 |

Table 4 shows the visual clarity of each formulation after five (5) weeks of storage at various temperature.

TABLE 4

Visual Clarity after storage for five (5) weeks at various temperatures.

| Formulation | Room Temperature (21° C.) | 5° C. | 37° C. |
|---|---|---|---|
| 1 | Clear | Clear | Clear |
| 2 | Clear | Clear | Clear |
| 3 | Clear | Clear | Clear |
| 4 | Clear | Hazy | Clear |
| 5 | Clear | Hazy | Clear |
| 6 | Clear | Clear | Clear |

The results reported in Table 4 show that formulations without TGME and DGME demonstrate instability after low temperature storage.

Table 5: Viscosity in cps of formulations without TGME and DGME after storage at various times at 37° C.

TABLE 5

Viscosity after storage at various times at 37° C.

| Storage Time (weeks) | Formulation 4 | Formulation 5 | Formulation 6 |
|---|---|---|---|
| 2 | 2100 | 2200 | 2100 |
| 3 | 1650 | 1875 | 1770 |
| 5 | 1450 | 1585 | 1580 |
| 10 | 1150 | 1335 | 1060 |

The results reported in Table 5 demonstrate the instability and variation of viscosity in formulations without TGME and DGME due to the use of different fragrances.

Table 6 lists the ingredients by their generic names and tradenames, and their suppliers.

TABLE 6

List of Ingredients: Generic names and Tradenames, and Suppliers.

| Generic Name | Tradename | Supplier |
|---|---|---|
| Isopropanol | | Union Carbide Corporation (Danbury, CT) |
| Diethylene glycol monoethyl ether | CARBITOL ® | Union Carbide Corporation (Danbury, CT) |

What is claimed is:

1. A viscosity-stabilising cleaning composition comprising a mixture of glycol monomethyl ethers and monoethyl ether in the absence of boron or boron-containing compounds.

2. A viscosily-stabilising composition according to claim 1 wherein the mixture of ether is selected from the group consisting of:

diethylene glycol monoethyl ether, tripropylene glycol monomethyl ether, and dipropylene glycol monomethyl ether.

3. A viscosity-stabilising composition according to claim 1 wherein the mixture contains: dipropylene glycol monomethyl ether and tripropylene, glycol monomethyl ether.

4. A viscosity-stabilising composition according to claim 1 additionally comprising a sodium di-alkyl sulphosuccinate.

5. A viscosity-stabilising composition according to claim 2 additionally comprising a di-alkyl sulphosuccinate.

6. A viscosity-stabilising composition according to claim 2 wherein the ratio of dipropylene glycol monomethyl ether:tripropylene glycol monomethyl ether: sodium dialkyl sulphosuccinate is 1:1:2.

7. A viscosity-stabilizing composition according to claim 1 additionally comprising one or more further ingredients selected from the group consisting of: a fragrance, a dye, a preservative, and an anti-lime scale agent.

8. A cleaning composition comprising a mixture of ethers in the absence of boron or boron-containing compounds according to claim 1, further comprising:

a modified cellulose;

an ethoxylated anionic surfactant;

a sodium di-alkyl sulphosuccinate;

a further anionic surfactant; and, water.

9. A cleaning composition according to claim 8, wherein the dipropylene glycol monomethyl ether and tripropylene glycol monomethyl ether are independently present in amounts of from about 0.5 to 5.0% by weight.

10. A cleaning composition according to claims 8, additionally comprising a sodium di-alkyl sulphosuccinate in an amount of from about 1 to about 10% by weight.

11. A cleaning composition according to claim 8 wherein the modified cellulose is selected from the group consisting of hydroxyethyl cellulose, hydroxypropyl cellulose, methyl cellulose, hydroxypropyl methyl cellulose, ethyl hydroxyethyl cellulose, methyl hydroxyethyl cellulose, and combinations thereof.

12. A cleaning composition according to claim 8 wherein the ethoxylated anionic surfactant is selected from: (1) sodium alkyl ethoxy sulphate, (2) C11 primary alcohol with an average of approximately 3 moles of ethylene oxide per mole of alcohol, (3) C11 primary alcohol with an average of approximately 5 moles of ethylene oxide per mole of alcohol, (4) C11 primary alcohol with an average of approximately 7 moles of ethylene oxide per mole of alcohol, (5) C11 primary alcohol with an average of approximately 9 moles of ethylene oxide per mole of alcohol, (8) C9–C11 primary alcohol with an average of approximately 2.5 moles of ethylene oxide per mole of alcohol, (7) C9–C11 primary alcohol with an average of approximately 5 moles of ethylene oxide per mole of alcohol, (8) C9–C11 primary alcohol with an average of approximately 6 moles of ethylene oxide per mole of alcohol, (9) C9–C11 primary alcohol with an average of approximately 8 moles of ethylene oxide per mole of alcohol, (10) C12–C13 primary alcohol with an average of approximately 1 mole of ethylene oxide per mole of alcohol, (11) C9–C13 primary alcohol with en average of approximately 2 moles of ethylene oxide per mole of alcohol, (12) C9–C11 primary alcohol with an average of approximately 3 moles of ethylene oxide per mole of alcohol, (13) C9–C11 primary alcohol with an average of approximately 8.5 moles of ethylene oxide per mole of alcohol, (14) C12–C15 primary alcohol with an average of approximately 2.5 moles of ethylene oxide per mole of alcohol, (15) C12–C15 primary alcohol with an average of approximately 3 moles of ethylene oxide per mole of alcohol, (16) C12–C15 primary alcohol with an average of approximately 5 moles of ethylene oxide per mole of alcohol, (17) C12–C15 primary alcohol with an average of approximately 7 moles of ethylene oxide per mole of alcohol, (18) C12–C15 primary alcohol with an average of approximately 9 moles of ethylene oxide per mole of alcohol, (19) C14–C15 primary alcohol with an average of approximately 4 moles of ethylene oxide per mole of alcohol, (20) C14–C15 primary alcohol with an average of approximately 5 moles of ethylene oxide per mole of alcohol, (21) C14–C15 primary alcohol with an average of approximately 7 moles of ethylene oxide per mole of alcohol, (22) C11, C14–C15 primary alcohol with an average of approximately 2 moles of ethylene oxide per mole of alcohol, and (23) combinations thereof.

13. A cleaning composition according to claim 8 wherein the further anionic surfactant is selected from the group consisting of: sodium lauryl sulphate, alkyl sulfates, ethoxylated alkyl sulfates, alkyl glyceryl ether sulfonates, methyl acyl taurates, fatty acyl glycinates, alkyl ethoxy carboxylates, N-acyl glutamates, acyl isethionates, alkyl sulfosuccinates, alkyl ethoxy sulphosuccinates, alpha-sulfonated fatty acids, their salts and/or their esters, alkyl phosphate esters, ethoxylated alkyl phosphate esters, acyl sarcosinates, fatty acid/protein condensates, and mixture thereof.

14. A cleaning composition according to claim 8 additionally comprising a non-ionic surfactant.

15. A cleaning composition according to claim 8 wherein:

the modified cellulose is hydroxyethyl cellulose, the mixture of ethers comprises diethylene glycol monoethyl ether, tripropylene glycol monomethyl ether, and dipropylene glycol monomethyl ether, the ethoxylated anionic surfactant is sodium alkyl ethoxy sulphate, the further anionic surfactant is sodium lauryl sulphate, and;

the non-ionic surfactant is cocoamide diethanolamine.

16. A cleaning composition according to claim 8 additionally comprising one or more further ingredients selected from the group consisting of a fragrance, a dye, a preservative, and an anti-lime scale agent.

17. A method of stabilising the viscosity of a cleaning composition which comprises the steps of:

admixing the viscosity-stabilising composition according to claim 1 with further ingredients of a cleaning composition.

18. A method according to claim 17 wherein the further ingredients include:

a modified cellulose;

an ethoxylated anionic surfactant;

a sodium di-alkyl sulphosuccinate;

a further anionic surfactant; and, water.

* * * * *

UNITED STATES PATENT AND TRADEMARK OFFICE

CERTIFICATE OF CORRECTION

PATENT NO. : 6,835,705 B2
DATED : December 28, 2004
INVENTOR(S) : Anjum Shaukat et al.

It is certified that error appears in the above-identified patent and that said Letters Patent is hereby corrected as shown below:

Column 8,
Line 32, "ethers" should read -- ether(s) --
Line 43, there should be no comma after the word "tripropylene"

Signed and Sealed this

Twenty-sixth Day of April, 2005

JON W. DUDAS
*Director of the United States Patent and Trademark Office*